US006783464B1

(12) United States Patent
Romano

(10) Patent No.: US 6,783,464 B1
(45) **Date of Patent: *Aug. 31, 2004**

(54) GOLF SWING TRAINER

(76) Inventor: Edward A Romano, P.O. Box 1792, Pebble Beach, CA (US) 93953-1792

( * ) Notice: Subject to any disclaimer, the term of this patent is extended or adjusted under 35 U.S.C. 154(b) by 0 days.

This patent is subject to a terminal disclaimer.

(21) Appl. No.: 08/329,864

(22) Filed: Oct. 26, 1994

Related U.S. Application Data

(63) Continuation-in-part of application No. 08/101,607, filed on Aug. 3, 1993, now Pat. No. 5,474,299.

(51) Int. Cl.[7] ..... A63B 69/36
(52) U.S. Cl. ..... 473/208; 473/212
(58) Field of Search ..... 473/207, 208, 473/212, 213, 214

(56) References Cited

U.S. PATENT DOCUMENTS

| | | | | | |
|---|---|---|---|---|---|
| 1,410,811 | A | * | 3/1922 | Lewis | 273/35 A |
| 2,093,153 | A | * | 9/1937 | McCarthy | 273/189 R |
| 3,109,244 | A | * | 11/1963 | Trifaro et al. | 273/189 R X |
| 3,940,144 | A | * | 2/1976 | Dickie | 273/188 R X |
| 5,040,798 | A | * | 8/1991 | Leitao | 273/189 R X |
| 5,062,642 | A | * | 11/1991 | Berry | 273/188 A X |
| 5,149,099 | A | * | 9/1992 | Radakovich | 273/189 R |
| 5,297,796 | A | * | 3/1994 | Peterson | 273/183.1 |
| 5,474,299 | A | * | 12/1995 | Romano | 273/187.2 |

* cited by examiner

*Primary Examiner*—William H. Grieb

(57) ABSTRACT

This Continuation invention provides a system of self-contained swing motion sensors borne and powered by the golfer's body that permit a golfer to track his swing movements by artificial markers which assist him to visualize and rapidly memorize given swing action models.

2 Claims, 9 Drawing Sheets

GOLF SWING TRAINER

This invention disclosure is a continuation-in-part of Ser. No. 08/101,607 filed Aug. 3, 1993 now U.S. Pat. No. 5,474,299 granted on Dec. 12, 1995 describing a Golf Swing Trainer with separate elements that signal a training golfer when the individual component motions of his swing deviate from ideal circular swing motion.

BACKGROUND OF THE INVENTION CONTINUATION

Unlike prior art devices, the continuation-in-part inventions concepts expounded herein integrate their golf swing logic, modelling and monitoring function with the golfer's persona. Some are suitable for instruction of students of other swing activities including baseball, tennis etc., gymnastics, ballet, skating, swimming etc.

SUMMARY

Disclosed is a set of six additional stand-alone light weight, ideal-circular-golf-swing modelling aids called Swing Motion Feedback Sensors TM (Sensors TM) commercialized together in a kit called The Home Pro (Pocket Pro). All assist a training golfer to consciously develop sound physiologically consistent circular swing habits.

The trainee secures each Sensor singly or jointly to targeted parts of his body where the Sensor rides and generates spontaneous swing feedback signals that assist him to correctly model and concurrently monitor individually targeted component motions of the ideal circular swing role model he wishes to emulate. The Sensor's connection to his body may be visual and physical. Unlike prior art, all Sensors permit the golfer to train with regular clubs including putter and driver, free from mechanically restrictive devices, special clubs, external feedback monitors and the like.

Thumbmirror

This Sensor orbits with the golfer's hands from over the thumbnail of the top hand of his grip, where he sets its small plain mirror to reflect his eyes from the start of the backswing motion. He harnesses the reflection and the mirror's center line marking as dynamic optical swing aids in ensuing swings, for modelling and monitoring body, hand, eye coordination and movement. Thumbmirror is most useful while the golfer's hands and club are below hip height.

Stretch Sensors TM

These are vivid, red etc. colored light sinewy lines or loops that associate targeted elements of the golfer's body, optically and physically, with dynamic outlines set up at address. Their shape-tension changes in the swing are applied in the invention in spider-web-prey-like logic to generate on-line modelling monitoring swing feedback signals.

Body Hand Sensor

This associates eyes optically to a body hand loop connection.

Torso Coil Sensor

This links shoulders to hips by a loop connection.

Lower Body Turn Sensor

This associates eyes visually to a line connecting the golfer's feet and hips.

The Baton

This tubular device has telescoping ends.Armlets hold to the golfer's shoulders where it highlights their alignment, turn and rocking action.

Centrifugal Bob Weight Sensors

These rod-like weights hang from the golfer's shoulders via armlets with parallel function to the Baton.

DESCRIPTION OF SPECIFIC EMBODIMENTS

INTRODUCTION

Figure 1A:
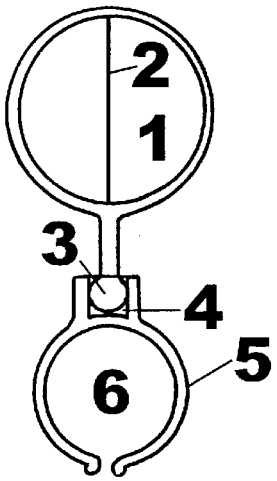
FIG. 1A depicts Thumbmirror in plan view.
Figure 1B:
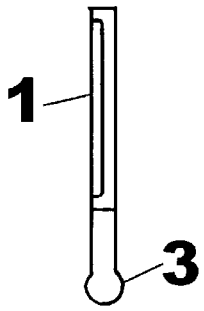
FIG. 1B is a side view of the mirror element.
Figure 1C:
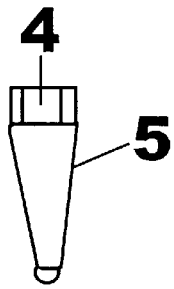
FIG. 1C is a side view of the Thumbmirror's ringlike base.

The Swing Motion Feedback Sensors create a dynamic space lattice that rides with the golfer's body as he swings, thereby extending his awareness of how his body should perform a chosen role model swing, and revealing how he actually performs those actions.

Through a simple start-stop motion calibration step upon first use of the Sensor selected, the golfer models, develops and integrates himself with the notion of how he should move the portion of his anatomy called upon by the Sensor in modelling the component swing motion it targets.

The calibration procedure for each Sensor is presented in the Disclosure section bearing its name.

In ensuing swings following calibration, the golfer trains by trial and error initially in start-stop mode. The golfer's mind and body become integrated with the Sensor so he sees and feels the Sensor's actual swing response signalling continuously. He relates signalling directly to clubhead/clubface feel. Equally, he can track actual swing deviation from his ideal role model swing by mentally comparing the Sensor's actual swing response behavior to its calibrated behavior.

After some practice, the golfer reacts as if the Sensors were present, even when they are not. He recalls their role from memory and swings with the assurance of strengthening solid swing habits imprinted in his memory by sensory images. Swing feedback is spontaneous, dramatic, specific and naturally amplified by the dynamic space lattice created by the Sensors around the golfer's persona.

Thumbmirror

In Thumbmirror his reflection moves predictably. Its dramatic signalling power is complemented by positional signalling of the mirror's center line marking at the key swing waypoints characteristic of the trainee's chosen swing model.

Stretch Sensors

The Stretch Sensors respond predictably and strikingly to swing events by changing shape and position on the golfer's body under internal tensions generated in them by the golfer's swing actions. The golfer both sees and feels these changes spontaneously and learns to relate them both to clubhead feel and calibrated swing model behavior directly.

Baton and Bob Weight Sensors

Baton and Bob Weight Sensors are visual markers that emphasise position of shoulders in swing motions. The Baton can also physically guide stroke action by being rested against the frame of an open doorway etc. The spectrum of swing feedback and modelling sensations generated by Home Pro Sensors is so vivid and striking that it hastens understanding of swing mechanisms with imagery that imprints quickly in memory so correct technique can be recalled spontaneously.

The system is a powerful tool for communicating swing concepts between teacher and student, even where language barriers exist. Sound swing technique must be accurately understood before it can be committed to memory to become solid swing habit when reinforced by accurate patterned repetitions.

The power and simplicity of the Sensors makes them well suited for live instruction of student groups, while enabling trainees who don't have access to live instruction to advance their golfing skills rapidly and affordably by video, photo illustrations or written instruction. The Sensors are effective with all; clubs from putter to driver at swing speeds conducive to correct and rapid learning, including start-stop trial and error, slow motion, forward and reverse, regular speed with imaginary or real balls.

They are ideal vehicles for swing analysis exploiting high speed film and computer simulation.

Market test feedback suggests that beginners and average golfers can reduce their handicap rating by several strokes after one to two hours' use, and that sustained use of Sensors over some months of routine practice can result in double-digit improvement. Advanced golfers progress by systematic elimination of weak links.

The Sensors are durable, simple and can be positioned ready for use on the golfer's body within seconds of being taken from the golfer's pocket. They fit golfers from 5 ft. to 6 ft. 6 ins (1.5 to 2.0 meters) and are failsafe.

The System

The Home Pro Sensors

A failing of prior art golf swing trainers is their manifest inability to enable average golfers to both understand and memorize what they must do by habit to play consistently well when swinging regular clubs, putter and driver included, even after protracted training with the devices. It would seem that prior art devices suffer from a combination of design weaknesses including suppression of clubhead feel, unwieldlyness, improper swing modelling, insensitive error detection and deficient signalling of correct error feedback.

Thumbmirror

Thumbmirror's orbital swing modelling and on-line error signalling feedback power coupled with simplicity and portability overcome prior art shortcomings.

In its mirror, which rides over the thumbnail of the upper hand of the golfer's grip where he sets it to reflect his eyes at address, the golfer sees from his reflection if his eyes/neck are square to line as they need to be to direct swing energy from clubface ball target. When the mirror and his reflection move as he starts to swing, the golfer can see when, how and why unwanted wrist club action in the vicinity of the ball can throw the club out of plane, because wrist action tilts his reflection from view predictably but in a flash. Conversely, when his takeaway action rotates club and arms axially around hisleft arm and spine without unwanted wrist action, he sees his eye reflection travel centered in the mirror at the pace of his turning body to the right and parallel to the ball target line.

As he continues the backswing turn, the reflection disappears parallel to line when his wrists begin to cock with the mirror center line and clubface rolling toward vertical.

This dramatic and precise feedback is available because the orbiting Thumbmirror is both near the hinge point of his wrists and at armslength from the center of primary rotation of body and arms from his spine, i.e. close to eyes and neck.

The power of this feedback helps the golfer to learn at first in slow start-stop mode how to become an habitually straight ball striker by maintaining correct swing alignment from address to well beyond impact, while supressing disruptive use of wrists. He discovers by rapid trial and error with clearly signalled on-line differentiated error feedback how arms and body must rotate about the base of his neck to propell his hands in a stable ring-like path parallel to the ball target line, with axial co-rotation of left arm, hands and clubface that squares the clubface for impact.

Thumbmirror stimulates the golfer intellectually to form correct swing habits by virtue of its feedback integration with his persona. The golfer can take it from his pocket to rehearse a particular shot if desired, then remove it to perform the swing confidently even in competition.

FIG. 1A shows the subject Thumbmirror is a 0.4 oz 1¼ in. dia. (10 gm 30 mm) round or square plain mirror 1 with a center line marking 2 available from Plews with a 3/16th in. dia. (4.6 mm) ball base 3. The ball fits with 2 percent interference in the socket 4 of a ringlike base 5 injection molded of acetal thermoplastic resin and having two integral ⅝ in. I.D. (15 mm) fingers 6, 1/16 in. (1.5 mm) thick and ¼ in. (6.25 mm) wide which the golfer slips over the mid section of his right thumb FIG. 1D. The golfer sets the mirror above his thumbnail 6 FIG. 1D and angles it so he sees his eyes 7 reflecting in it 1 when addressing the ball 8. He can swing freely without mechanical inhibition or loss of clubhead feel since the Thumbmirror is of negligible weight and size compared to his body/club.

Figure 1D:
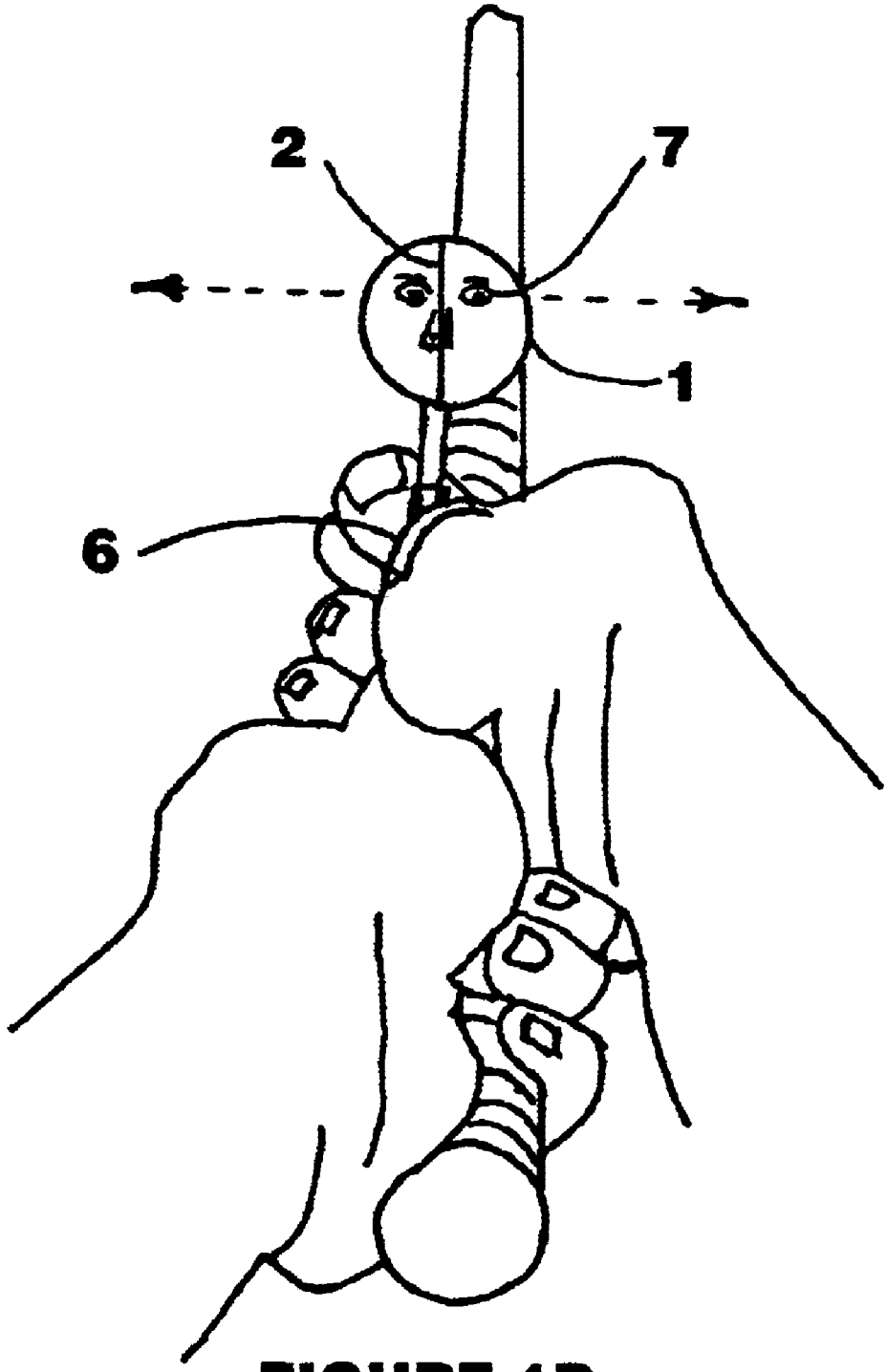
FIG. 1D depicts the golfer's view of his eyes reflecting in the Thumbmirror at address as the golfer makes a "big" swing backswing.

The reflection 7 moves in response to motion of the golfer's hands, mirror and club FIG. 1D relative to his eyes and spine during the swing, as shown by FIG. 1E arrows 9 through 18. Motion of the reflection is valuable as a large dynamic space lattice conspicuous in the golfer's peripheral vision while his hands and club are below hip height. There, it is a powerful tool useful for modelling his chosen role model ideal swing, and his actual swing, address alignment, swing alignment and timing. Its range can be extended by additional swing feedback generated by the position of its centerline marking at key swing waypoints. Motion of the reflection magnifies the golfer's awareness of his hands/club motion relative to his eyes and spine by optical projection of the reflection as the mirror swings with the golfer's hands.

If he flexes his wrists at arms length without moving body or arms, his hands pivot from the wrists and his eye reflection responds by flashing from view across the mirror face or returning to it as the case may be in a predictable direction exemplified by arrows 9 to 16 FIG. 1E. In contrast, when he rotates body, shoulders, clubface as a single unit around the nub of his neck without wrist action, he sees the reflection travel slowly parallel to line in step with his turning body and remain centered in the mirror FIG. 1E arrows 9 and 10. When wrist action begins in the middle of such a motion, the golfer sees his reflection suddenly accelerate and disappear in a direction matching the wrist rotation. If wrist action is correct, it will keep the clubshaft on plane and the reflection will disappear parallel to line per arrows 9 and 10 FIG. 1E. If wrist action is out of plane, the reflection disappears heading towards or away from the ball target line FIG. 1E arrows 11 to 16. As long as his eyes and neck remain square to the ball target line when he swings, the golfer's eye reflection in the mirror can travel square to the ball target line FIG. 1E arrows 9 to 16. Even when his hands rotate, the mirror's frame/centerline and the clubface clockwise under impetus of axial rotation of his left forearm, as occurs in ideal "big" swing action arrow 17, or anti-clockwise in downswing arrow 18 FIG. 1E, his eye reflection will be square to line if his eyes and neck have remained square.

Figure 5A:
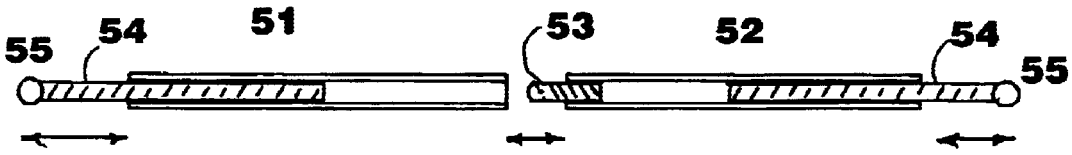
FIG. 5A shows a Baton TM in plan view and reveals it is composed of two halves that screw together and have a telescoping end.
Figure 5B:
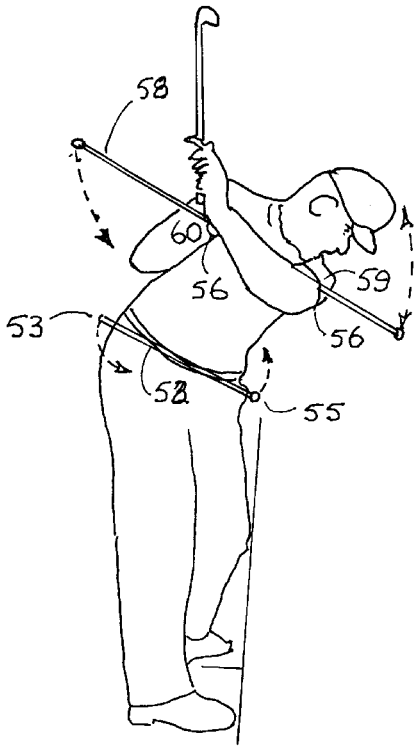
"FIG. 5B depicts golf swing training feedback provided by one baton passed through the golfer's belt-loops and a second baton affixed to the golfer's upper arms."
Figure 5C:
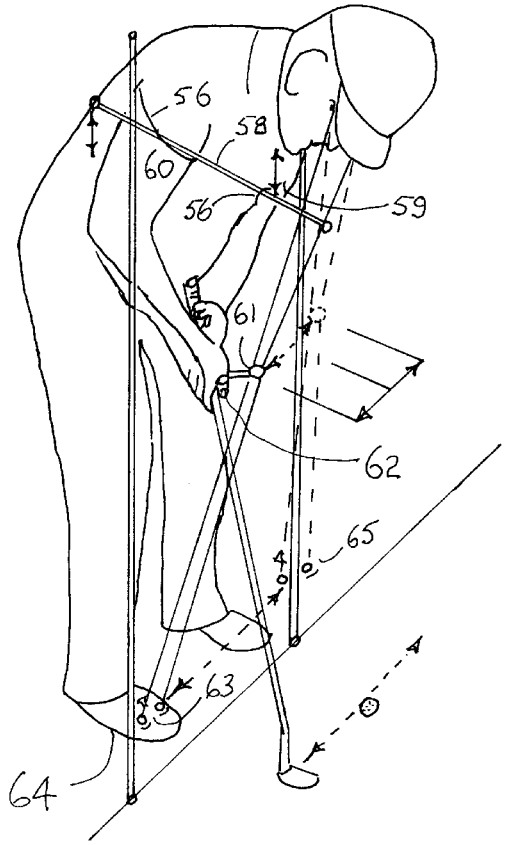
"FIG. 5C depicts the baton used in conjunction with a Thumbmirror by a golfer for vertical shoulder pendulum putting practice with both ends of the Baton rested against vertial poles planted in the ground on a line representing the golfer's ball-target line."
Figure 6A:
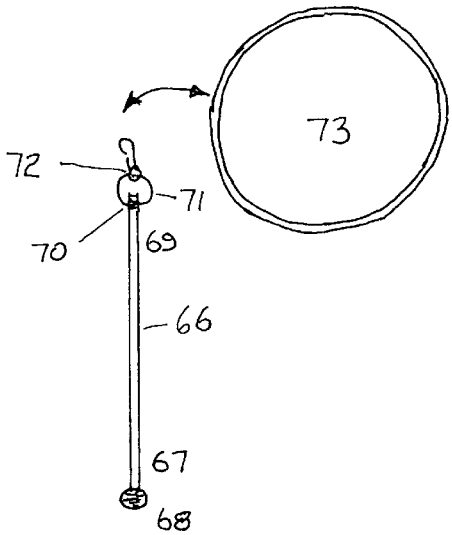
FIG. 6A shows a Bobweight Sensor TM and rubber armlet in plan view.
Figure 6C:
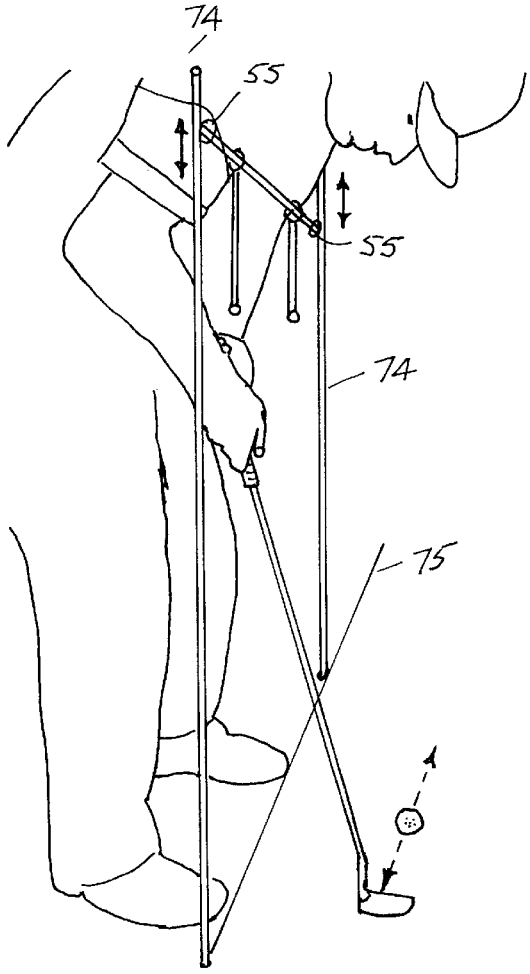
FIG. 6C depicts a golfer using Bob Weight Sensors and Baton together for modelling/practicing vertical shoulder pendulum putting strokes with Baton ends resting against either vertical guide poles or the wall surfaces of a doorway opening.

In vertical shoulder pendulum putting style strokes, the golfer strives to keep hands, clubface and mirror centerline square to the ball target line continuously while rocking his shoulders around his outstretched neck parallel to the same line without wrist effort FIG. 1E arrows 9 and 10 FIGS. 5C and 6C.

With ideal backswing action the reflection swings in an arc of 6 to 8 ft. radius (2 to 2.5 meters) from its address position FIG. 1E arrow 9, travelling to the golfer's right parallel to the ball target line and remains square to line centered in the mirror. With correct technique in the "big" swing backswing, the progression of spinal rotation coupled with cocking (i.e. flexing) of the wrists rotates the hands, club and mirror biaxially, lifting them progressively to the "top" of the swing. The reflection disappears FIG. 1E in direction of arrow 9 with the mirror, hands and clubface doing a slow roll in direction of arrow 18, while the golfer's eye reflection remains square and parallel to the ball target line.

At that point the clubhead will have swung 1½ to 3 ft. of arc (0.5 to 1.0 meters) from address. Soon after, when the golfer's hands pass beyond the center outside of his right foot so that hands and club are about hip height, most swing models have the clubface/mirror centerline tilted between about 30 degrees below vertical to vertical. At this important swing waypoint the clubshaft should be parallel to the ball target line.

In the "big" swing downswing, the reflection should reappear at the same point it disappears in the backswing but now travelling to the golfer's left FIG. 1E arrow 10. It continues left parallel to the ball target line with the hands, mirror and clubface rolling slowly anti-clockwise around the axis of the left arm FIG. 1E arrow 17 as the clubface and mirror centerline roll back to square for impact and beyond to the top of the finish. The reflection disappears when the clubhead is 1½ to 3 ft. (0.5 to 1.0 meters) beyond impact.

As hands and club approach hip height, the hands should pass beyond the center and outside of the golfer's left foot. At that point the mirror centerline should be about 30 degrees off-vertical open or closed depending on the swing model to about vertical, with the clubshaft near parallel to the ball target line.

When the golfer's body turns during the swing his neck and eyes should stay square to line so his reflection when visible should confirm this important fact. If eyes and neck are not square, the golfer's swing plane must have rotated away from parallel to the ball target line. The centerline of the Thumbmirror is distinctly visible for much broader widths of arc and up to much higher swing speeds that either the clubface or the golfer's reflection in the Thumbmirror, which extends the range of usefulness of the Thumbmirror as a high speed swing aid considerably.

Undesirable swing actions are conspicuous in the Thumbmirror, because deviations from ideal circular swing motion cause the reflection and mirror's centerline to waver away from or towards the ball target line as depicted by error signals shown as arrows 11 through 16 FIG. 1E. Mostly, these result from false movements associated with picking up the club with independent arm handswings irrespective of body rotation.

The Body Hand Sensor

Figure 2A:
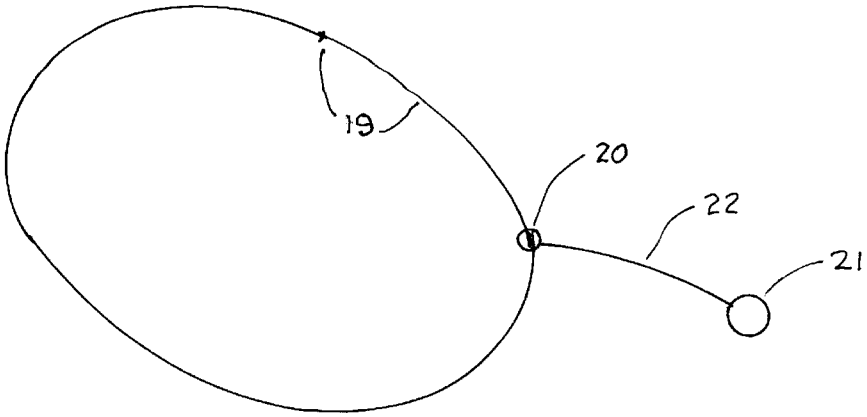
FIG. 2A depicts Body Hand Sensor Loop and Thumbstrap.

The Body Hand Sensor is for "big" swing training and teaches the golfer to develop maximum radius of gyration with full extension of at least one arm throughout the swing with coordinated co-rotation of body and arms. The 0.2 oz (6 gm) Sensor is made from a 3 ft. length of 3/32–⅛" dia. (2.4–3.2 mm) extruded stretch resistant red polyurethane resin Shore Hardness A60 available from Du Pont, butt-welded end-to-end to form a stretch resistant loop 19 FIG. 2A passing through the eye of a 1" chrome plated steel snap hook 20 free to slide easily for load equalisation around loop 19 FIG. 2A. The snap end of the hook is held by a knot at one end of a 12" (30 cm) length of low spring rate silicone rubber tubing ⅛×1/16" (3.2×1.6 mm) available from GE and whose other end is knotted to form a 1" (25 mm) loop 21 part of Thumb Strap 22 FIG. 2A. The length of the Thumb Strap can be shortened by re-positioning its end knot. Its short length and low spring rate ensure user safety in the event of mis-use.

Figure 2B:
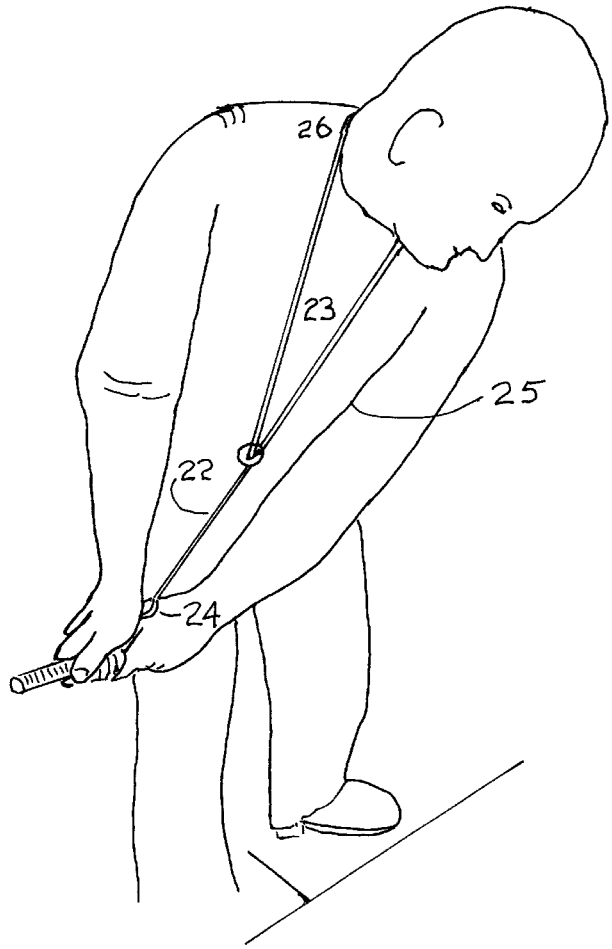
FIG. 2B shows a right-handed golfer performing a "big" swing backswing with Thumbstrap and Loop stretched from his right thumb.

As depicted in FIG. 2B, the golfer drops loop 19 around his neck and inserts his left thumb (right for lefthand players) into loop 21 of Thumb Strap 22 and addresses the ball with chosen club and usual grip. Extension of his arms at address forms loop 23 connected by stretch of Thumb Strap 22 down to his left thumb 24 at the apex of "Vee" 25 formed between the golfer's two arms and left thumb 24. With good backswing technique exemplified by FIG. 2B, the golfer should rotate body, hands and club as one for several feet of clubhead arc starting the clubhead back from the ball parallel to the ball target line.

In this event, as depicted in FIG. 2B, both "Vees" 23 and 25 remain centered with one-another and intact with the base of red Sensor "Vee" 23 resting on the golfer's breast bones 26. However, if he starts back by lifting the club using wrist arm power independent of his body rotation, Thumb Strap 22 slackens, the base of red "Vee" 23 begins to lift away from his breastbones 26 as the "Vee" itself sags and collapses progressively. These are strong error signals seen and felt by the golfer to which he can respond instantly to begin exploring for solutions to the errors by trial and error.

With proper technique and extension of his left arm in the backswing, the red "Vee" 23 stays intact to the top of the backswing.

In the downswing, it is rejoined by "Vee" 25 when the latter reforms as the right arm straightens near impact. Through impact and beyond, the red "Vee" accompanies "Vee" 25 as the latter strengthens when the golfer's both arms extend centrifugally after impact. The Sensor then behaves in mirror image fashion to its performance in the backswing. The right arm remains extended to the top of the finish, while the left arms folds.

Torso Coil Sensor

The Torso Coil Sensor 0.2 oz (6 gm) enables the golfer to sense rotation of his shoulders relative to hips by monitoring relative motion between one shoulder and the opposite hip through a sensor connection between them that passes diagonally across the golfer's back or chest. The Coil Sensor makes him aware that correct "big" swing backswing turn action creates a sense of spinal coiling and muscular loading around an athletically steady right hip. Sensor feedback helps the golfer avoid a common golfing backswing fault namely swaying of the golfer's body back from and to the right parallel to the ball target line, instead of coiling shoulders and hips around a stable right hip.

Figure 3A:
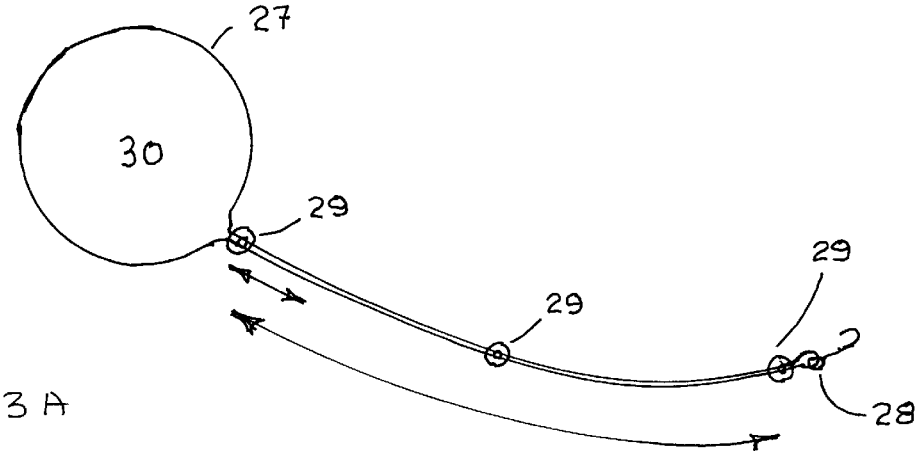
FIG. 3A illustrates a Torso Coil Stretch Sensor TM.

The Sensor is made from a 5 ft. (1.7 meter) length of 3/32 to 1/8 in. dia. (2.4 to 3.2 mm) extrusion of stretch resistent polyurethane resin Shore hardress A60 available in red color from Du Pont, and which is butt welded end-to-end to form a stretch-resistent loop FIG. 3A 27 passed through the eye of a 1 in. (25 mm) snap hook. Three 5/16 in. (8 mm) nylon or similar balls 29 with a through-hole of 5/32 in. dia. (7.5 mm) unite loop 27 together at the snap hook, at the Sensor's mid point and at some distance from the Sensor's other end, which forms an adjustable shoulder loop 30 FIG. 3A.

Figure 3B:
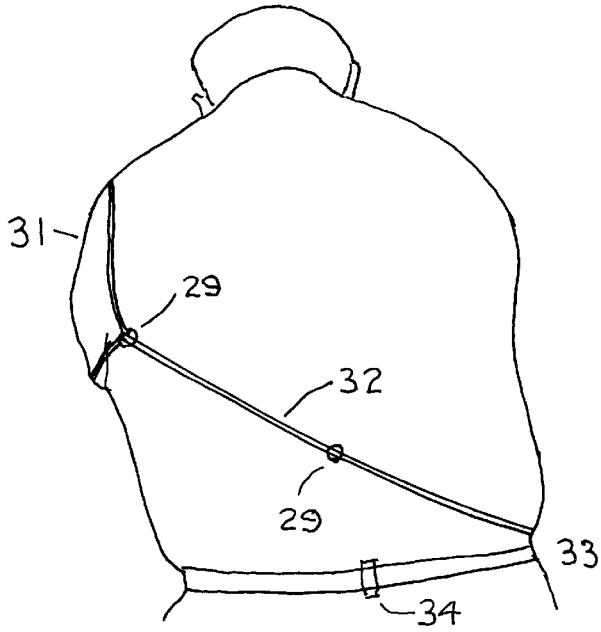
FIG. 3B depicts a golfer ready to perform a "big" swing backswing with the Torso Coil Stretch Sensor looped about his left shoulder, stretched across his back and hooked to a trouser belt loop by his right hip.

FIG. 3B depicts the golfer at address with stretched center loop 30 around his left shoulder 31 and routed diagonally across his back 32 with hook 28 attached to a belt loop of his trousers adjacent to his right hip 33. Tension in line 32 at address is set by location of the belt loop anchor point.

To calibrate the Sensor, the golfer rotates shoulders and hips in slow motion and judges by sensing tightening and slackening of the line against his back, which coiling action in the backswing produces greater backswing tension and coil. In the downswing, he repeats the process seeking to maintain maximum coil well into the finish action beyond impact by starting the downswing with smooth rotation of his lower body and allowing his arms and club to drop under gravity and be rotated by centrifugal impetus rather than by deliberately pulling down on the club grip like a bell rope.

Greater sense of shoulder rotation after impact can be achieved at the expense of ability to feel backswing coil of shoulder and hip via the Sensor, by switching Sensor arrangement from right shoulder across the back to the golfer's left hip. A third possibility also encourages the golfer to rotate body/shoulders freely to the finish, is to attach shoulder loop 30 to left shoulder 31, then route hook 28 diagonally across and down his chest around his right hip to be hooked to a rear belt loop 34.

The golfer chooses practice mode Sensor arrangement most helpful for his personal improvement.

The Lower Body Turn Sensor

This 0.7 oz (20 gm) Sensor is for modelling/monitoring lower body turn action in the "big" swing. It connects the golfer's feet and hips on the same side of his body together as well as connecting one hip to the other.

Figure 4A:
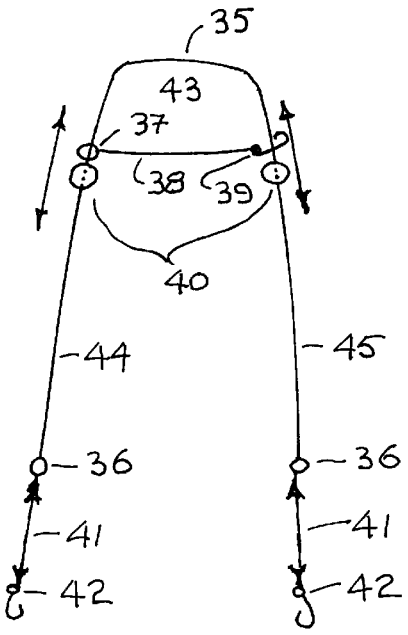
FIG. 4A shows the Lower Body Turn Sensor connections between hips and feet.
Figure 4B:
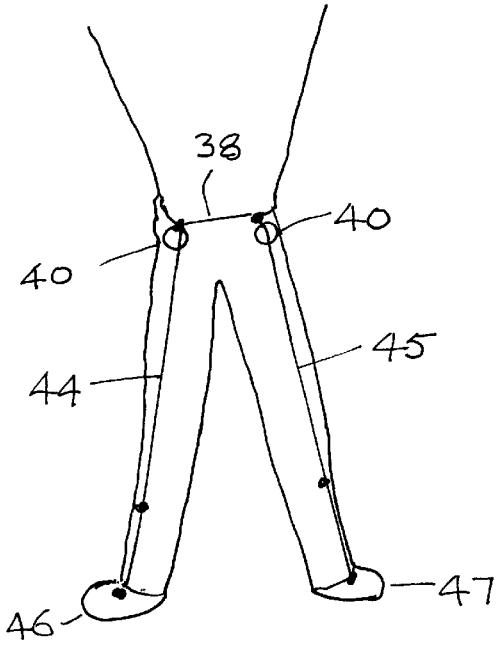
FIG. 4B shows it in position on a standing golfer free to swing or walk.

The Sensor depicted in FIG. 4A is made of a 72 in. (1.9 meter) length 35 of 3/32 to 1/8 in. dia. (2.4 to 3.2 mm) extrusion of stretch resistent polyurethane resin of Shore hardness A60 of red color available from Du Pont. Each of its two ends is hot plate welded and formed into a 1/8 in. (3.2 mm) dia. eyelet 36 after the hot plate formed eyelet end 37 of a 9 in. (13.5 cm) hip connector link 38 with a 1 in. (25 mm) metal hook 39 at its other end has been threaded onto line 35 along with two 5/16 in. (8.5 mm) dia. balls of nylon or similar 40 with I.D. hole of 1/8 in. (3.2 mm).

A 12 in. (30 cm) length of silicone rubber tubing 41 of 1/8 in. by 1/16 in. I.D. (3.2 by 1. 6 mm) available from General Electric is passed through each eyelet 36 and knotted at one end with its other end subsequently tied permanently to a snap hook 42.

Figure 4C:
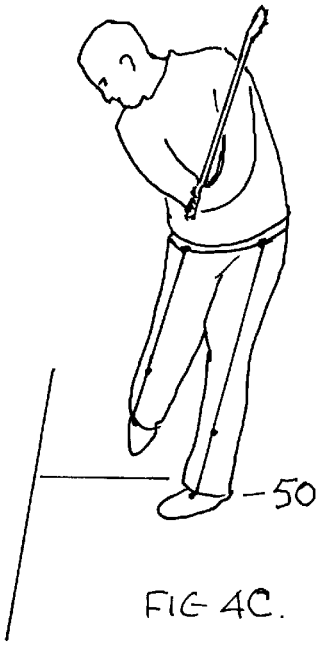
FIG. 4C depicts it seen from the target side of a golfer's "big" swing after impact.
Figure 4D:
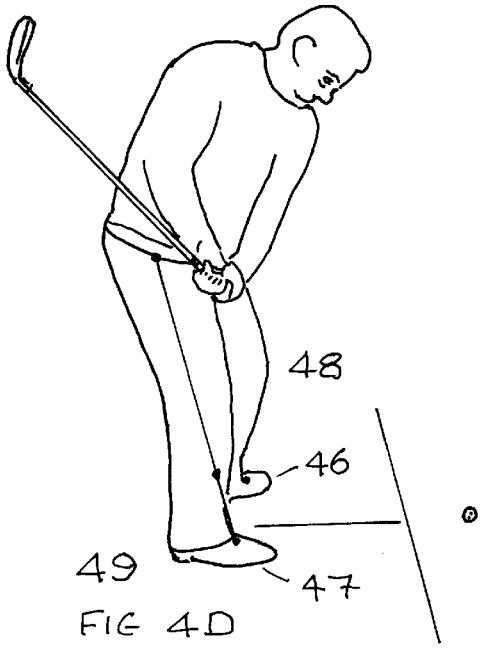
FIG. 4D shows it seen from the backswing side of a golfer's "big" swing.

The golfer passes the center section 43 of the Sensor thus created around his back as depicted in FIG. 4D and hooks it from hip to hip by engaging hook 39 above the nylon ball 40 opposite. The golfer equalizes line through balls 40 and sets them so the right leg riser 44 is the same length as left leg riser 45. Then he hooks hook 42 of each leg riser 44, 45 respectively to the laces of his right and left shoes 46, 47. If necessary he reties the knot of elastic section 41 to adjust the length of leg risers and tension 44, 45.

With proper backswing body turn action as depicted in FIG. 4D the golfer's left knee 48 slips inside left riser 45 while right leg riser 44 stretches back from his right heel 49 as weight transfers to it and left riser 45 relaxes outside his left leg and knee 48.

In the downswing shown in FIG. 4C both knees turn inside risers 44, 45 respectively, the left riser 45 stretches back from left heel 50 as weight transfers there. At the finish, the right leg riser 44 should be eased and aimed at the target with the golfer balanced with both knees close to one another.

Error signals are manifest when the golfer sways parallel to the ball target line instead of turning correctly. The false move stretches either or both leg risers across the golfer's foot outside the footprint of his shoes.

The Baton Sensor

The Baton Sensor is a sighting aid for modelling and monitoring the alignment and rotations of shoulders and/or hips simultaneously or separately relative to one another and to the target line. It can also serve for creating fixed separation between the golfer's left and right upper arms at address throughout the swing.

It is useful for "big" swing style strokes, as well as for practice of vertical pendulum strokes where shoulders and clubhead rotate exclusively parallel to the ball target line.

FIG. 5A is a plan view in cross section depicting the near symmetrical right and left halves 51 and 52 respectively of the assembled and extended Baton 58. The body of the Baton halves is made of light weight high strength aluminum steel alloy or of filament-wound glass carbon fiber reinforced epoxy arrow shaft materials available from Easton and Glasforms respectively. The body of the two halves 51 and 52 is 12"×5/16 OD by ¼" ID (30 cm×8 mm×6.3 mm) that bayonet together via a 1¼" long×¼" CD (30 mm×6.3 mm) quick release pin 53 bonded into 52 with Bondini adhesive. 51 and 52 feature an integral internal telescoping ¼" OD (6.3 mm) birch wood dowel 11" long (27.5 cm) 54 with an integral end cap 55.

In "big" swing uses depicted in FIG. 5B armlets 56 made of silicone tubing 12" long×⅛"×1/16" (30 cm×3.2 mm×1.6 mm) tied into a loop secure the Baton 58 to the golfer's left upper arm 59 and right upper arm 60. This arrangement is useful for monitoring alignment of the shoulders to the ball target line at address as well as for maintaining a specific separation between the golfer's upper arms during the swing.

An alternate use arrangement is to separate the Baton halves, one half being telescoped to span 20" and use with armlets as described above for modelling shoulder action, while the Baton's other half serves as illustrated in FIG. 5B on the hips of the golfer by being inserted through the trouser loops of the golfer's opposite hips. This enables hip and shoulder alignment to be monitored concurrently.

The address alignment and swing motion of shoulders and hips relative to one another and to the target line in the swing depends on teachings of the golfer's chosen swing role model but all can be readily modelled as described above.

Use of the Baton in vertical pendulum putting shoulder-dominated strokes is depicted in FIG. 5C with armlets 56 securing the assembled Baton 58 to the golfer's right and left upper arms 60, 65 with the Baton furthermore resting against upright poles planted in the ground to act as guides vertically above the ball target line. the golfer is further depicted wearing the Thumbmirror 61 using his reflection 63 in it as it appears over his right shoe 64 at the end of his backswing stroke to monitor hand/shoulder/clubface unity of action in conjunction with the swing aiming function of the Baton duplicated by motion of the golfer's reflection parallel to the ball target line on completion of the through stroke as it appears over his left shoe 65.

In conventional "big" swing style putting strokes, the golfer rotates shoulders, hands and clubhead around the tilted axis of his spine rather than horizontally around his outstretched neck as in vertical pendulum putting strokes. The Baton is helpful for monitoring rotation of the golfer's shoulders and upper arms relative to the ball target line, as well as for maintaining sense of unity between upper arms in proximity to the chest.

Bob Weight Sensors

These are rod-shaped pendular weights that can be appended via armlets or threaded on the Baton's dowel extensions to hang from the golfer's upper arms. If the golfer's shoulder motion is purely vertical, the Bob Weights move only vertically, whereas horizontal or centrifugal motions swing the Bob Weights out of a vertical plane. The response of Bob Weights appended to each of the golfer's shoulders reveals whether movement of the golfer's two shoulders is symmetrical, vertical or rotational with a horizontal component.

FIG. 6A shows the Bob Weight hanging in side elevation adjacent to an armlet. The Bob is made of a 5" long×¼" dia. (12.5 cm×6.3 mm) extrusionof Delrin or Nylon 66 with its free end 67 inserted into a ⅝" (16 mm) dia. or similar plastic ball 68. Its other end 69 has a 3/32" (4.3 mm) through hole that captures a ¾" steel split ring 71 passed through the eye of an open snap hook 72. The Bob Weight can be clipped via its snap hook to an armlet 73 so that one Bob Weight hangs from a point at each one of the golfer's upper arms depicted in FIG. 6B. Alternatively, the wooden extension of both ends of a Baton FIG. 5A can be removed to pass the Baton tip dowel FIG. 5A 55 into the Bob Weight's steel split ring 71 then reinserted into the Baton so that the Bob Weights hang one from each end of the Baton as shown in FIG. 6C.

Figure 6B:
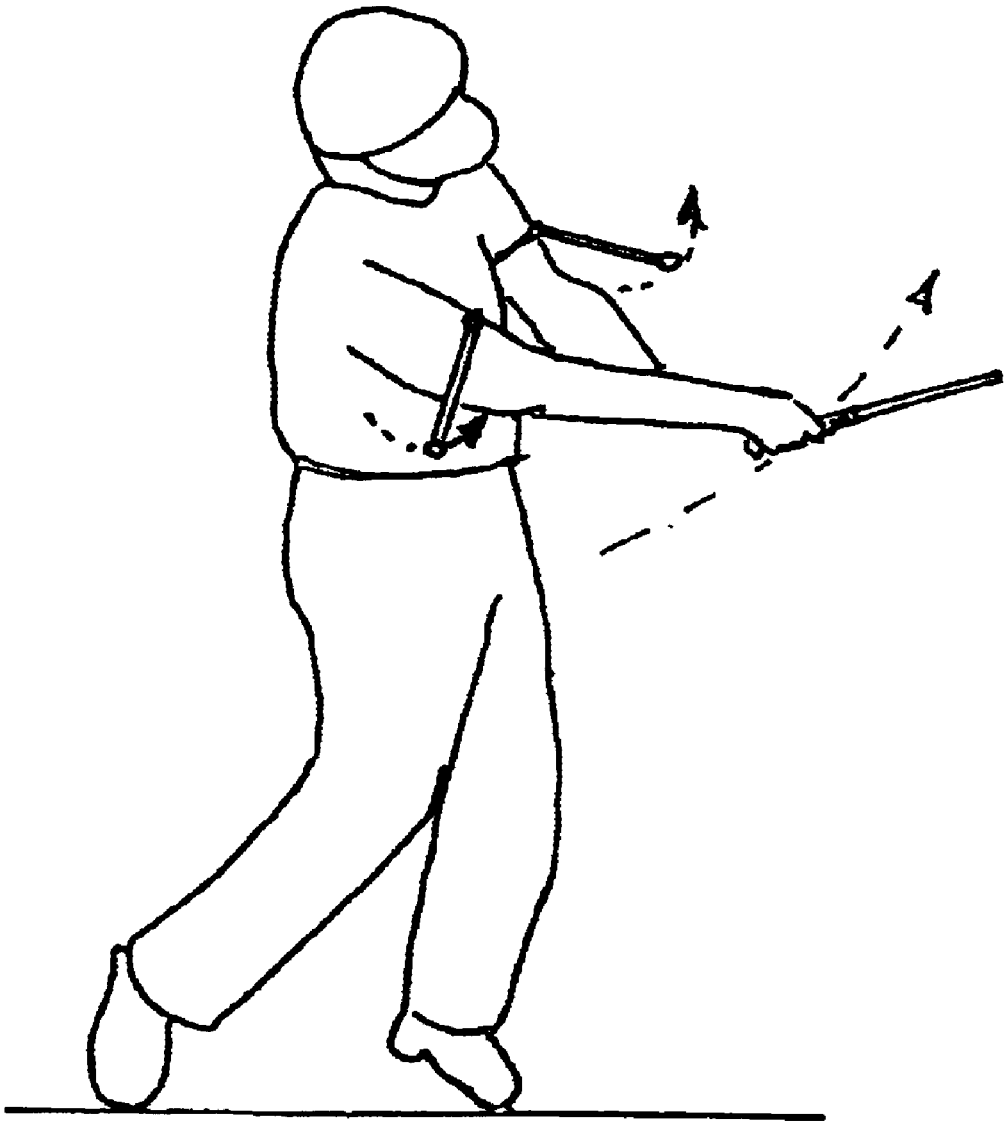
FIG. 6B depicts golfer's "big" swing follow through with both Bob Weight Sensors flying symmetrically from his shoulders in response to similar centrifugal forces generated by his ideal swing turning motion.

Use of the Bob Weights is illustrated in FIG. 6B for "big" swing action and in FIG. 6C for vertical pendulum putting.

When the golfer's shoulder motion is purely vertical FIG. 6C both Bob Weights hang vertically over a common ball target line. Non-vertical shoulder motions rotate the Bobs from the vertical plane, in which case both Bobs fly equally if the rotational speed of both shoulders is uniform around the spine, otherwise not.

FIG. 6B shows the golfer in a full swing with both Bob Weights following similar arcs matching the direction of rotation, indicating that the golfer's shoulders are turning from a common center on his spine at the same speed. Conversely, had the golfer lunged down the target line instead of rotating, the motion of the weights would be uneven.

FIG. 6C depicts the golfer practicing vertical pendulum putting strokes with the Baton and Bob Weights hung from the Baton, with the Baton against the golfer's upper arms and Baton ends pointing at vertical poles 74 rising up from the ball target line 75. The balls rise and fall vertically directly above the ball target line as long as the Baton tips move only vertically pointing at the upright poles 74 planted on the ball target line 75.

CONCLUSION

The system described above in this Continuation-in-Part to Ser. No. 08/101,607 greatly assists developing golfers and advanced golfers to assimilate the proper swing techniques of a role model. Specific embodiments have been described in detail for clarity and ease of understanding, however significant departures from the described embodiments may be made without departing from the teachings of the invention. Therefore the scope of the invention should be determined with reference to the appended claims along with the full scope of equivalents to which those claims are entitled.

What is claimed is:

1. A direct feedback golf swing training device comprising;

a loop of stretch-resistant material free to swivel as a V-shaped tether around a golfer's neck, an elastic connecting line having first and second ends, said first end attached to said loop, a ring, said ring attached to the second end of said connecting line, said ring adapted to receive a golfer's thumb, said loop, connecting line and ring forming a Y-shaped configuration when a golfer places a thumb in the ring while gripping a golf club, whereby the shape, position, tension and alignment of the Y-shaped configuration permit a golfer to compare his swing movement to a given standard, or from one swing to the next, by recognizing the motion pattern of the Y-shaped configuration.

2. The device of claim 1, wherein the connecting line is of sufficient length to be barely taut when at least one of the golfer's arms is extended from address for the duration of the swing.

* * * * *